US009324269B2

(12) United States Patent
Chung et al.

(10) Patent No.: US 9,324,269 B2
(45) Date of Patent: Apr. 26, 2016

(54) SCAN DRIVING DEVICE AND METHOD OF DRIVING THE SAME

(75) Inventors: Bo-Yong Chung, Yongin (KR); Yong-Jae Kim, Yongin (KR); Chul-Kyu Kang, Yongin (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 979 days.

(21) Appl. No.: 13/469,289

(22) Filed: May 11, 2012

(65) Prior Publication Data

US 2013/0120326 A1 May 16, 2013

(30) Foreign Application Priority Data

Nov. 14, 2011 (KR) ..... 10-2011-0118368

(51) Int. Cl.
*G09G 5/00* (2006.01)
*G09G 3/32* (2016.01)

(52) U.S. Cl.
CPC ..... *G09G 3/3266* (2013.01)

(58) Field of Classification Search
USPC ..... 345/87, 204
See application file for complete search history.

(56) References Cited

U.S. PATENT DOCUMENTS

| | | | | |
|---|---|---|---|---|
| 7,319,452 | B2 * | 1/2008 | Moon | G11C 19/28 345/100 |
| 2007/0274433 | A1 * | 11/2007 | Tobita | 377/64 |
| 2008/0055208 | A1 * | 3/2008 | Chung | 345/76 |
| 2010/0283715 | A1 * | 11/2010 | Kretz et al. | 345/100 |

FOREIGN PATENT DOCUMENTS

| | | | |
|---|---|---|---|
| JP | 2010-186551 | A | 8/2010 |
| KR | 10-2011-0050303 | A | 5/2011 |
| KR | 10-2011-0080385 | A | 7/2011 |
| KR | 10-2012-0009593 | A | 2/2012 |
| WO | WO 2010/015621 | A | 2/2010 |

* cited by examiner

*Primary Examiner* — Calvin C Ma
(74) *Attorney, Agent, or Firm* — Lee & Morse, P.C.

(57) ABSTRACT

A scan driving device includes scan driving blocks, each including: a first node receiving a signal that is input to a first driving signal input terminal according to a clock signal input to a first clock signal input terminal; a second node receiving a second power source voltage according to the clock signal input to the first clock signal input terminal and a signal input to a second driving signal input terminal; a first transistor including a gate electrode connected to the second node and an electrode receiving an output control signal; a second transistor including a gate electrode connected to the first node and an electrode connected to a second clock signal input terminal; and a third transistor including a gate electrode connected to the second node, an electrode connected to a first power source voltage, and another electrode connected to the first node.

25 Claims, 11 Drawing Sheets

SCAN DRIVING DEVICE AND METHOD OF DRIVING THE SAME

CROSS-REFERENCE TO RELATED APPLICATION

This application claims priority to and the benefit of Korean Patent Application No. 10-2011-0118368 filed in the Korean Intellectual Property Office on Nov. 14, 2011, the entire contents of which are incorporated herein by reference.

BACKGROUND

1. Field

Embodiments relate to a scan driving device and a method of driving the same. More particularly, embodiments relate to a scan driving device and a method of driving the same that may stably output a scan signal.

2. Description of the Related Art

In order to display an image, a flat panel display sequentially applies a scan signal of a gate-on voltage to a plurality of scan lines and applies a data signal corresponding to a scan signal of a gate-on voltage to a plurality of data lines.

The above information disclosed in this Background section is only for enhancement of understanding and therefore it may contain information that does not form the prior art that is already known in this country to a person of ordinary skill in the art.

SUMMARY

A scan driving device, including a plurality of sequentially arranged scan driving blocks, each of the plurality of scan driving blocks including a first node to which a signal that is input to a first driving signal input terminal is transferred according to a clock signal that is input to a first clock signal input terminal, a second node to which a second power source voltage is transferred according to the clock signal that is input to the first clock signal input terminal and a signal that is input to a second driving signal input terminal, a first transistor including a gate electrode that is connected to the second node and an electrode to which an output control signal is input, a second transistor including a gate electrode that is connected to the first node and an electrode that is connected to a second clock signal input terminal, a contact point to which another electrode of the first transistor and another electrode of the second transistor are connected being an output terminal, and a third transistor including a gate electrode that is connected to the second node, an electrode that is connected to a first power source voltage, and another electrode that is connected to the first node.

Each of the plurality of scan driving blocks may further include a fourth transistor including a gate electrode that is connected to the first clock signal input terminal, an electrode that is connected to the first clock signal input terminal, and another electrode that is connected to the first node.

Each of the plurality of scan driving blocks may further include a fifth transistor including a gate electrode that is connected to the first driving signal input terminal and an electrode that is connected to the first power source voltage, and a sixth transistor including a gate electrode that is connected to the first clock signal input terminal, an electrode that is connected to another electrode of the fifth transistor, and another electrode that is connected to the second node.

Each of the plurality of scan driving blocks may further include a seventh transistor including a gate electrode that is connected to the second driving signal input terminal and an electrode that is connected to the second power source voltage, and an eighth transistor including a gate electrode that is connected to the first clock signal input terminal, an electrode that is connected to another electrode of the seventh transistor, and another electrode that is connected to the second node.

Each of the plurality of scan driving blocks may further include a first capacitor including an electrode that is connected to the first node and another electrode that is connected to the output terminal.

Each of the plurality of scan driving blocks may further include a second capacitor including an electrode to which the output control signal is input and another electrode that is connected to the second node.

A first clock signal may be input to a first clock signal input terminal of a plurality of first scan driving blocks of the plurality of scan driving blocks, and a second clock signal may be input to a second clock signal input terminal thereof, and the second clock signal may be input to a first clock signal input terminal of a remaining plurality of second scan driving blocks of the plurality of scan driving blocks, and the first clock signal may be input to a second clock signal input terminal thereof.

The second clock signal may be a signal that is shifted by duty of the first clock signal.

A scan signal of a previously arranged second scan driving block may be input to the first driving signal input terminal of a subsequently arranged first scan driving block, and a scan signal of a subsequently arranged second scan driving block may be input to a second driving signal input terminal of a previously arranged first scan driving block.

A scan signal of the previously arranged first scan driving block may be input to the first driving signal input terminal of the subsequently arranged second scan driving block, and a scan signal of the subsequently arranged first scan driving block may be input to the first driving signal input terminal of the previously arranged second scan driving block.

A first clock signal may be input to a first clock signal input terminal of a first scan driving block of one of the plurality of scan driving blocks, and a third clock signal that is shifted by duty of the first clock signal may be input to the second clock signal input terminal of the first scan driving block, and a second clock signal that is shifted by ½ duty of the first clock signal may be input to a first clock signal input terminal of a second scan driving block that is arranged after the first scan driving block, and a fourth clock signal that is shifted by ½ duty of the third clock signal may be input to the second clock signal input terminal of the second scan driving block.

A scan signal of a previously arranged scan driving block may be input to the first driving signal input terminal of the first scan driving block, and a scan signal of a scan driving block that is arranged after the second scan driving block may be input to the second driving signal input terminal of the first scan driving block.

A scan signal of the first scan driving block may be input to the first driving signal input terminal of the second scan driving block.

A first clock signal may be input to a first clock signal input terminal of a first scan driving block of one of the plurality of scan driving blocks, and a second clock signal that is shifted by ½ duty of the first clock signal may be input to the second clock signal input terminal of the first scan driving block, the second clock signal may be input to the first clock signal input terminal of a second scan driving block that is arranged after the first scan driving block, and a third clock signal that is shifted by ½ duty of the second clock signal may be input to the second clock signal input terminal of the second scan driving block, and the third clock signal may be input to a first clock signal input terminal of a third scan driving block that is arranged after the second scan driving block, and a fourth clock signal that is shifted by ½ duty of the third clock signal may be input to the second clock signal input terminal of the third scan driving block.

A scan signal of a previously arranged scan driving block may be input to the first driving signal input terminal of the first scan driving block, and a scan signal of the third scan driving block may be input to the second driving signal input terminal of the first scan driving block.

A scan signal of the first scan driving block may be input to a first driving signal input terminal of the second scan driving block.

Another embodiment is directed to a scan driving device, including a first node to which a signal that is input to a first driving signal input terminal is transferred according to a clock signal that is input to a first clock signal input terminal, a second node to which a signal that is input to a second driving signal input terminal is transferred according to the clock signal that is input to the first clock signal input terminal and the signal that is input to the second driving signal input terminal, a first transistor including a gate electrode that is connected to the second node and an electrode to which an output control signal is input, a second transistor including a gate electrode that is connected to the first node and an electrode that is connected to a second clock signal input terminal, a contact point to which another electrode of the first transistor and another electrode of the second transistor are connected being an output terminal, and a third transistor including a gate electrode that is connected to the second node, an electrode that is connected to a first power source voltage, and another electrode that is connected to the first node.

Another embodiment is directed to a scan driving device, including a first node to which a signal that is input to a first driving signal input terminal is transferred according to a clock signal that is input to a first clock signal input terminal, a second node to which a second power source voltage is transferred according to the clock signal that is input to the first clock signal input terminal and a signal that is input to a second driving signal input terminal, a first transistor including a gate electrode that is connected to the second node and an electrode to which an output control signal is input, a second transistor including a gate electrode that is connected to the first node and an electrode that is connected to a second clock signal input terminal, a contact point to which another electrode of the first transistor and another electrode of the second transistor are connected being an output terminal, and a third transistor including a gate electrode that is connected to the second node, an electrode that is connected to the second clock signal input terminal, and another electrode that is connected to the first node.

Another embodiment is directed to a method of driving a scan driving device that includes a plurality of scan driving blocks each including a first node, a second node, a first transistor that has a gate electrode connected to the second node and that transfers an output control signal to an output terminal, a second transistor that has a gate electrode connected to the first node and that transfers a second clock signal to the output terminal, a third transistor that has a gate electrode connected to the second node and that transfers a gate-off voltage to the first node, and a capacitor that is connected to the first node and the output terminal, the method including changing a voltage of the second node by the output control signal of a gate-on voltage, turning on the first transistor by a voltage change of the second node and outputting the output control signal of the gate-on voltage as a scan signal to the output terminal, and turning on the third transistor by a voltage change of the second node and turning off the second transistor by a first power source voltage having the gate-off voltage.

The changing of a voltage of the second node and the outputting of the output control signal of the gate-on voltage may simultaneously occur in the plurality of scan driving blocks.

The method may further include applying a scan signal of a gate-on voltage that is output by a previously arranged scan driving block of the plurality of scan driving blocks according to the second clock signal to the first node, turning on the second transistor by a gate-on voltage of the first node and outputting the second clock signal of a gate-off voltage as a scan signal to the output terminal, and charging the capacitor with a gate-on voltage of the first node and a gate-off voltage of the output terminal.

The second clock signal may be a signal that is shifted by duty of the first clock signal.

The second clock signal may be a signal that is shifted by ½ duty of the first clock signal.

The method may further include changing the first clock signal to a gate-on voltage, turning on the second transistor by boot strap through the capacitor, and outputting the second clock signal of the gate-on voltage as the scan signal to the output terminal.

The method may further include applying a gate-on voltage to the second node by the second clock signal and a scan signal of a gate-on voltage of a subsequently arranged scan driving block of the plurality of scan driving blocks, turning on the first transistor by a gate-on voltage of the second node and outputting an output control signal of a gate-off voltage as the scan signal to the output terminal, and transferring a gate-off voltage to the first node by turning on the third transistor by a gate-on voltage of the second node and turning off the second transistor by a gate-off voltage of the first node.

DETAILED DESCRIPTION

Figure 1:
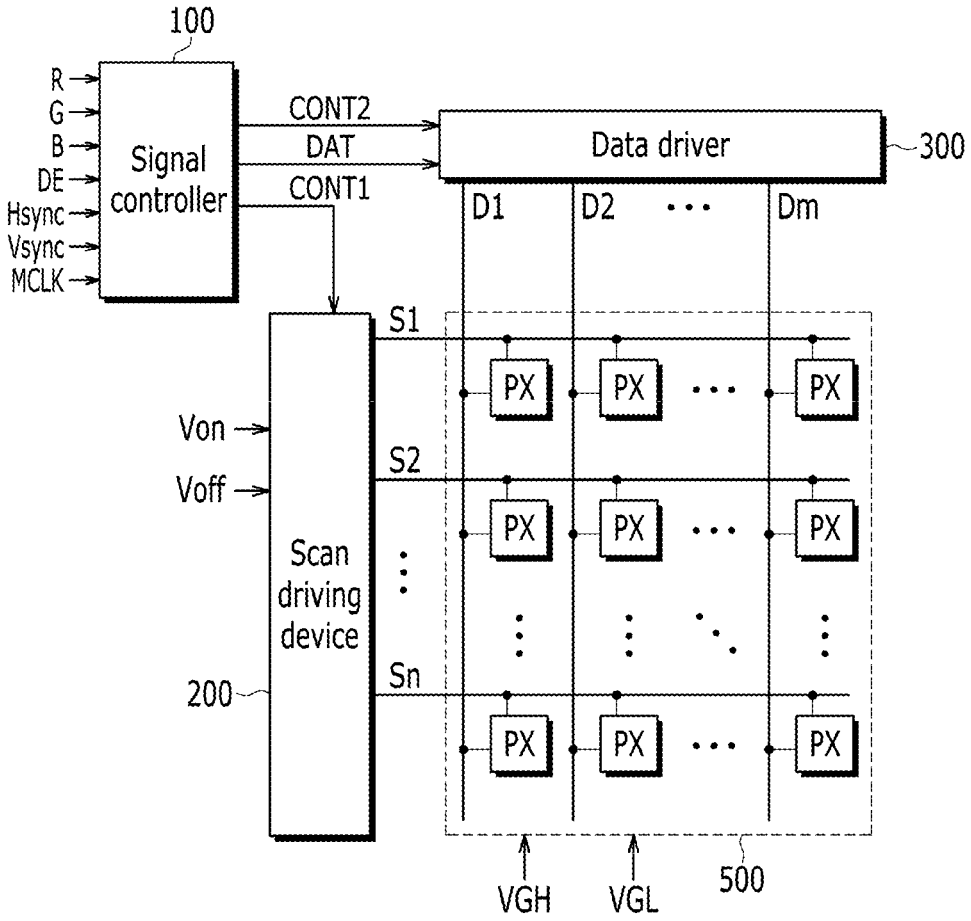
FIG. 1 is a block diagram illustrating a display device according to an example embodiment.

Embodiments will be described more fully hereinafter with reference to the accompanying drawings, in which example embodiments are shown. As those skilled in the art would realize, the described embodiments may be modified in various different ways, all without departing from the spirit or scope of the disclosure.

Further, like reference numerals designate like elements in several example embodiments and are representatively described in a first example embodiment and elements different from those of the first example embodiment will be described in other example embodiments.

The drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising", will be understood to imply the inclusion of stated elements but not the exclusion of any other elements.

FIG. 1 is a block diagram illustrating a display device according to an example embodiment.

In the example embodiment shown in FIG. 1, the display device includes a signal controller 100, a scan driving device 200, a data driver 300, and a display unit 500.

The signal controller 100 receives video signals R, G, and B that are input from an external device and an input control signal that controls the display of the video signals R, G, and B. The video signals R, G, and B include luminance information of each pixel PX, and luminance has grays of the given number, for example, 1024 ($=2^{10}$), 256 ($=2^{8}$), or 64 ($=2^{6}$). The input control signal includes, for example, a vertical synchronization signal Vsync, a horizontal synchronization signal Hsync, a main clock MCLK, and a data enable signal DE.

The signal controller 100 appropriately processes input video signals R, G, and B to correspond to an operation condition of the display unit 500 and the data driver 300 based on the input video signals R, G, and B and the input control signal and generates a scan control signal CONT1, a data control signal CONT2, and an image data signal DAT. The signal controller 100 transfers the scan control signal CONT1 to the scan driving device 200. The signal controller 100 transfers the data control signal CONT2 and the image data signal DAT to the data driver 300.

The display unit 500 includes a plurality of pixels PX that are connected to a plurality of scan lines S1-Sn, a plurality of data lines D1-Dm, and a plurality of signal lines S1-Sn and D1-Dm to be arranged in an approximately matrix form. The plurality of scan lines S1-Sn are extended in an approximately row direction and are almost parallel to each other. The plurality of data lines D1-Dm are extended in an approximately column direction and are almost parallel to each other. The plurality of pixels PX of the display unit 500 receive a first power source voltage VGH and a second power source voltage VGL from the outside.

The scan driving device 200 is connected to the plurality of scan lines S1-Sn and applies a scan signal that is formed with a combination of a gate-on voltage Von that turns on and a gate-off voltage Voff that turns off application of a data signal to the pixel PX according to the scan control signal CONT1 to the plurality of scan lines S1-Sn.

The scan control signal CONT1 includes a scan start signal SSP, a clock signal CLK, and an output control signal GCK. The scan start signal SSP generates a first scan signal for displaying an image of a frame. The clock signal CLK is a synchronization signal for sequentially applying a scan signal to the plurality of scan lines S1-Sn. The output control signal GCK is a signal that controls a scan signal to apply in a bundle to the plurality of scan lines S1-Sn.

The data driver 300 is connected to the plurality of data lines D1-Dm and selects a gray voltage according to an image data signal DAT. The data driver 300 applies a gray voltage that is selected according to the data control signal CONT2 as a data signal to the plurality of data lines D1-Dm.

Each of the above-described driving devices 100, 200, and 300 is mounted at the outside of a pixel area in a form of at least one integrated circuit chip, is mounted on a flexible printing circuit film, is attached to the display unit 500 in a form of a tape carrier package (TCP), is mounted on a separate printed circuit board, or is integrated at the outside of a pixel area together with the signal lines S1-Sn and D1-Dm.

The display device according to the present embodiment may be driven with a simultaneous light emitting method that uses a frame including a scan period in which a data signal is transferred and written to each of a plurality of pixels PX and a light emitting period that emits light according to a data signal in which each of a plurality of pixels PX is written.

Figure 2:
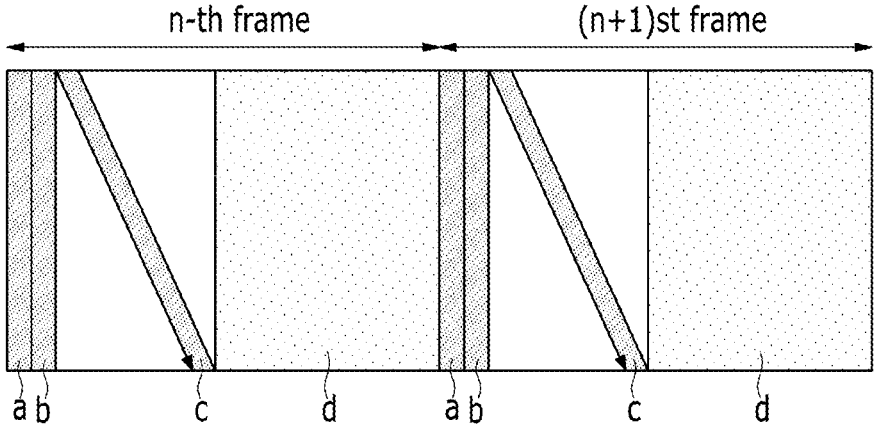
FIG. 2 is a diagram illustrating a driving operation of a simultaneous light emitting method of a display device according to an example embodiment.

FIG. 2 is a diagram illustrating a driving operation of a simultaneous light emitting method of a display device according to an example embodiment.

In the example embodiment shown in FIG. 2, it is assumed that a display device according to the present embodiment is an organic light emitting diode (OLED) display using an OLED. However, the present embodiment is not limited thereto and may be applied to various flat panel displays.

A method of driving the display device includes a reset step a that resets a driving voltage of an OLED of a pixel, a threshold voltage compensation step b that compensates a threshold voltage of a driving transistor of a pixel, a scan step c that transfers a data signal to each of a plurality of pixels, and a light emitting step d in which a plurality of pixels emit light to correspond to a transferred data signal.

In the example embodiment shown in FIG. 2, the scan step c sequentially performs on each scan line basis, but the reset step a, the threshold voltage compensation step b, and the light emitting step d are simultaneously performed in a bundle in the entire display unit 500.

Here, the scan driving device 200 of the display device according to the present embodiment sequentially applies a scan signal of a gate-on voltage Von to the plurality of scan lines S1-Sn at the scan step c and simultaneously applies a scan signal of a gate-on voltage Von to the plurality of scan lines S1-Sn at the reset step a and the threshold voltage compensation step b. Thus, the scan driving device 200 performs sequential application and simultaneous application of a scan signal according to a driving step of the display device.

Figure 3:
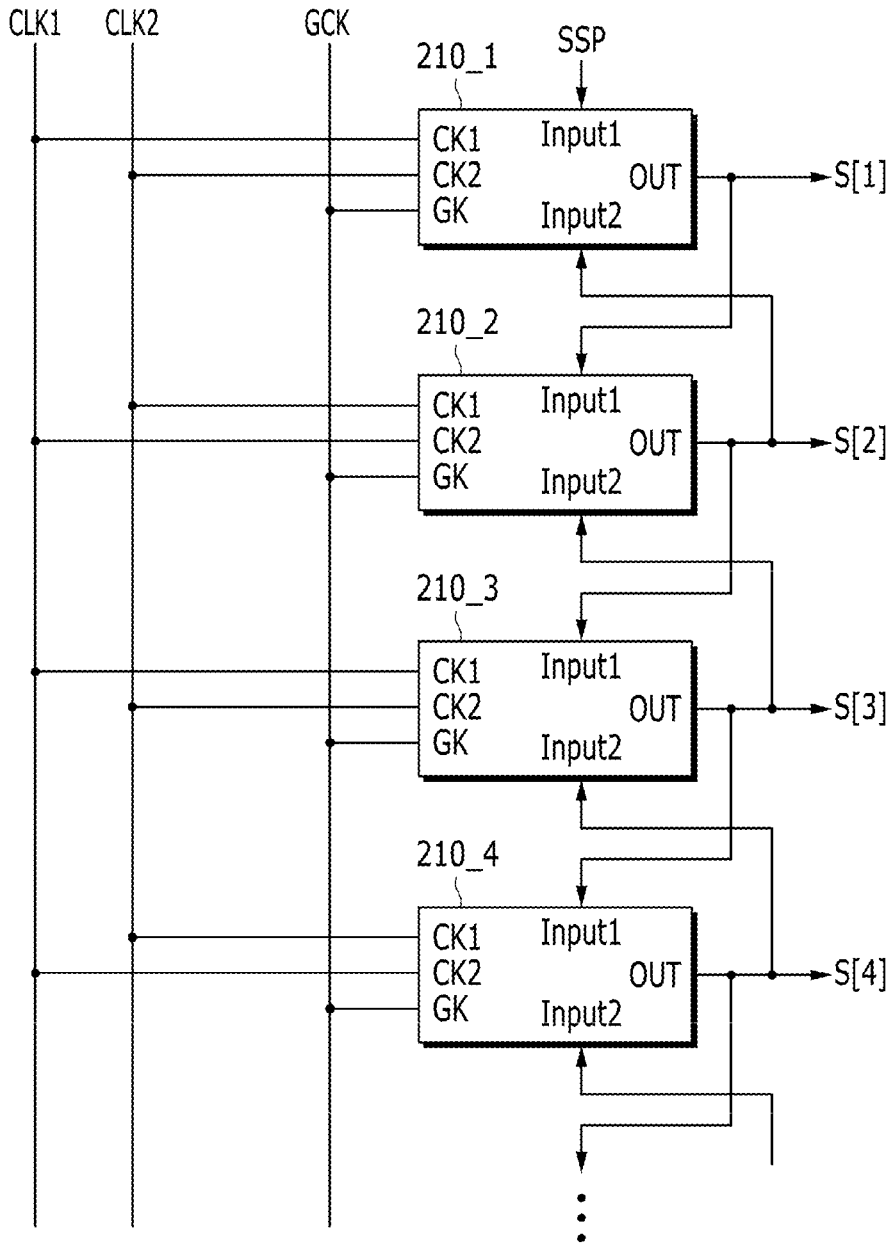
FIG. 3 is a block diagram illustrating a configuration of a scan driving device according to an example embodiment.

FIG. 3 is a block diagram illustrating a configuration of a scan driving device according to an example embodiment.

In the example embodiment shown in FIG. 3, the scan driving device includes a plurality of sequentially arranged scan driving blocks 210_1, 210_2, 210_3, 210_4, . . . . The scan driving blocks 210_1, 210_2, 210_3, 210_4, . . . receive an input signal and generate scan signals S[1], S[2], S[3], S[4], . . . that are transferred to the plurality of scan lines S1-Sn, respectively.

Each of the plurality of scan driving blocks 210_1, 210_2, 210_3, 210_4, . . . includes a first clock signal input terminal CK1, a second clock signal input terminal CK2, an output control signal input terminal GK, a first driving signal input terminal Input1, a second driving signal input terminal Input2, and an output terminal OUT.

A first clock signal CLK1 is input to a first clock signal input terminal CK1 of odd numbered scan driving blocks 210_1, 210_3, . . . of the plurality of scan driving blocks 210_1, 210_2, 210_3, 210_4, . . . , and a second clock signal CLK2 is input to a second clock signal input terminal CK2, thereof. A second clock signal CLK2 is input to a first clock signal input terminal CK1 of even numbered scan driving blocks 210_2, 210_4, . . . of the plurality of scan driving blocks 210_1, 210_2, 210_3, 210_4, . . . , and a first clock signal CLK1 is input to a second clock signal input terminal CK2 thereof.

An output control signal GCK is input to an output control signal input terminal GK of the plurality of scan driving blocks 210_1, 210_2, 210_3, 210_4, . . . .

A scan signal of a previously arranged scan driving block is input to a first driving signal input terminal Input1 of the plurality of scan driving blocks 210_1, 210_2, 210_3, 210_4, . . . , and a scan signal of a subsequently arranged scan driving block is input to a second driving signal input terminal Input2 thereof. Thus, a scan signal of previously arranged even numbered scan driving blocks is input to a first driving signal input terminal Input1 of odd numbered scan driving blocks, and a scan signal of subsequently arranged even numbered scan driving blocks is input to a second driving signal input terminal Input2 of odd numbered scan driving blocks. A scan signal of previously arranged odd numbered scan driving blocks is input to a first driving signal input terminal Input1 of even numbered scan driving blocks, and a scan signal of subsequently arranged odd numbered scan driving blocks is input to a second driving signal input terminal Input2 of even numbered scan driving blocks.

In an implementation, when the plurality of scan driving blocks 210_1, 210_2, 210_3, 210_4, . . . sequentially output a scan signal, a scan signal S[k−1] of a (K−1)st scan driving block 210_k−1 is input to a first driving signal input terminal Input1 of a k-th scan driving block 210_k, and a scan signal S[k+1] of a (K+1)st scan driving block 210_k+1 is input to a second driving signal input terminal Input2 thereof. In this case, a scan start signal SSP is input to a first driving signal input terminal Input1 of a first scan driving block 210_1.

Each of the scan driving blocks 210_1, 210_2, 210_3, 210_4, . . . outputs scan signals S[1], S[2], S[3], S[4], . . . that are generated according to a signal that is input to the first clock signal input terminal CK1, the second clock signal input terminal CK2, the output control signal input terminal GK, the first driving signal input terminal Input1, and the second driving signal input terminal Input2 to the output terminal OUT.

The first scan driving block 210_1 transfers a scan signal S[1] that is generated by receiving a scan start signal SSP to a first scan line S1 and a first driving signal input terminal Input1 of a second scan driving block 210_2. A k-th arranged scan driving block 210_k outputs a scan signal S[k] that is generated by receiving a scan signal S[k−1] that is output from a (K−1)st arranged scan driving block 210_k−1 (1≤k<=n).

Figure 4:
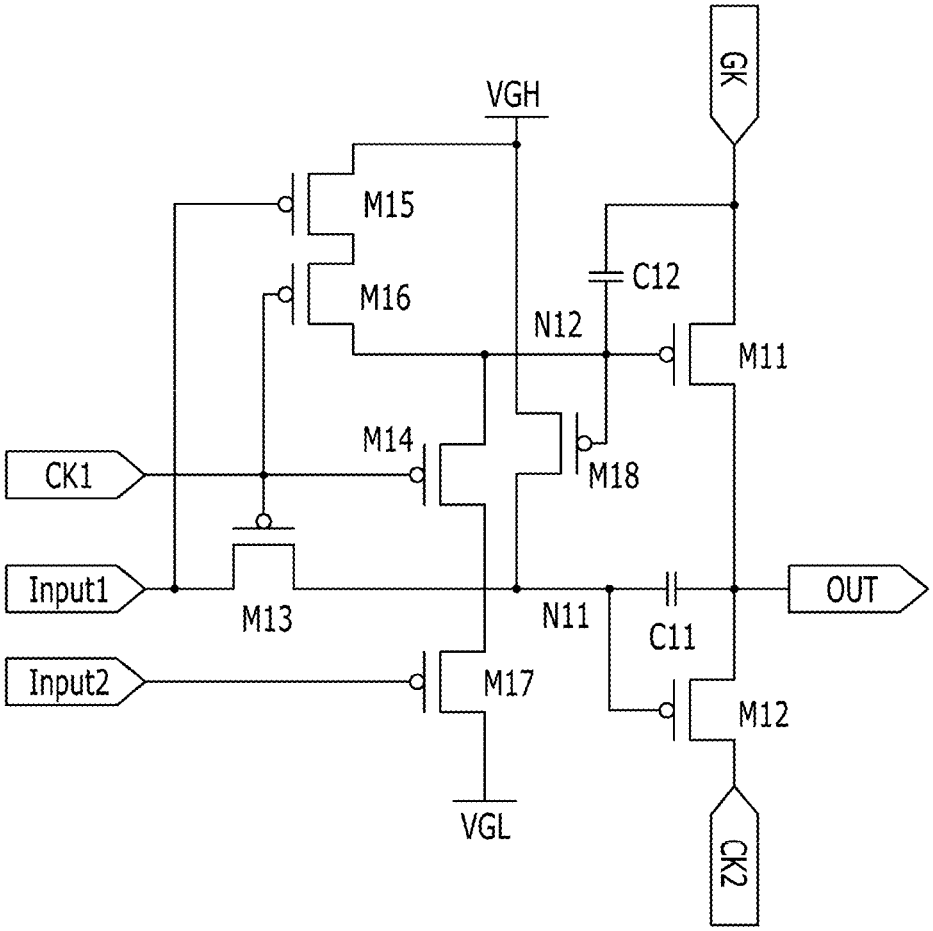
FIG. 4 is a circuit diagram illustrating an example embodiment of a scan driving block that is included in the scan driving device of FIG. 3.

FIG. 4 is a circuit diagram illustrating an example embodiment of a scan driving block that is included in the scan driving device of FIG. 3.

In the example embodiment shown in FIG. 4, the scan driving block includes a plurality of transistors M11, M12, M13, M14, M15, M16, M17, and M18 and a plurality of capacitors C11 and C12.

A first transistor M11 includes a gate electrode that is connected to a second node N12, one electrode that is connected to an output control signal input terminal GK, and another electrode that is connected to an output terminal OUT.

A second transistor M12 includes a gate electrode that is connected to a first node N11, one electrode that is connected to a second clock signal input terminal CK2, and another electrode that is connected to the output terminal OUT. A contact point to which the other electrode of the first transistor M11 and the other electrode of the second transistor M12 are connected is the output terminal OUT.

A third transistor M13 includes a gate electrode that is connected to a first clock signal input terminal CK1, one electrode that is connected to a first driving signal input terminal Input1, and another electrode that is connected to the first node N11.

A fourth transistor M14 includes a gate electrode that is connected to the first clock signal input terminal CK1, one electrode that is connected to another electrode of a seventh transistor M17, and another electrode that is connected to the second node N12.

A fifth transistor M15 includes a gate electrode that is connected to the first driving signal input terminal Input1, one electrode that is connected to a first power source voltage VGH, and another electrode that is connected to a sixth transistor M16.

The sixth transistor M16 includes a gate electrode that is connected to the first clock signal input terminal CK1, one electrode that is connected to the other electrode of the fifth transistor M15, and another electrode that is connected to the second node N12.

The seventh transistor M17 includes a gate electrode that is connected to a second driving signal input terminal Input2, one electrode that is connected to a second power source voltage VGL, and another electrode that is connected to one electrode of the fourth transistor M14.

An eighth transistor M18 includes a gate electrode that is connected to the second node N12, one electrode that is connected to the first power source voltage VGH, and another electrode that is connected to the first node N11.

A first capacitor C11 includes one electrode that is connected to the first node N11 and another electrode that is connected to the output terminal OUT. A second capacitor C12 includes one electrode that is connected to the output control signal input terminal GK and another electrode that is connected to the second node N12.

The first power source voltage VGH has a voltage of a logic high level, and the second power source voltage VGL has a voltage of a logic low level.

The plurality of transistors M11, M12, M13, M14, M15, M16, M17, and M18 are a p-channel field effect transistor. A gate-on voltage that turns on the plurality of transistors M11, M12, M13, M14, M15, M16, M17, and M18 is a voltage of a logic low level, and a gate-off voltage that turns off the plurality of transistors M11, M12, M13, M14, M15, M16, M17, and M18 is a voltage of a logic high level.

Figure 5:
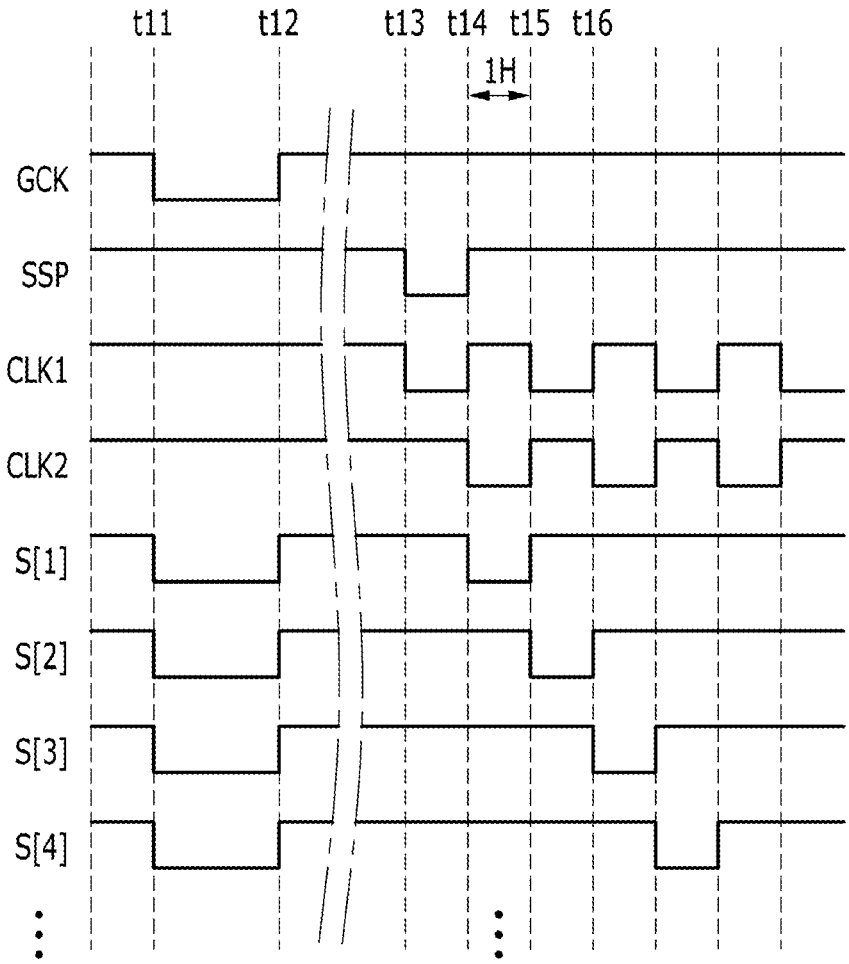
FIG. 5 is a timing diagram illustrating a method of driving the scan driving device of FIG. 3.

FIG. 5 is a timing diagram illustrating a method of driving the scan driving device of FIG. 3.

In the example embodiment shown in FIGS. 3 and 5, the scan driving device simultaneously outputs a scan signal of a gate-on voltage to a plurality of scan lines S1-Sn at a reset step a and a threshold voltage compensation step b and sequentially outputs a scan signal of a gate-on voltage to a plurality of scan lines S1-Sn at a scan step c.

A segment t11-t12 is one segment of a reset step a and a threshold voltage compensation step b in which a scan signal of a gate-on voltage is simultaneously output to a plurality of scan lines S1-Sn. At the segment t11-t12, an output control signal GCK is applied as a voltage of a logic low level, and a scan start signal SSP, a first clock signal CLK1, and a second clock signal CLK2 are applied as a voltage of a logic high level.

The first clock signal CLK1 or the second clock signal CLK2 of a logic high level is applied through the first clock signal input terminal CLK1 of the plurality of scan driving blocks 210_1, 210_2, 210_3, 210_4,. . . . The third transistor M13, the fourth transistor M14, and the sixth transistor M16 are turned off. Because the third transistor M13, the fourth transistor M14, and the sixth transistor M16 are turned off, the first node N11 and the second node N12 are in a floating state.

At a time point t11, because a voltage of the output control signal GCK is lowered from a logic high level to a logic low level, a voltage of the second node N12 of a floating state is lowered to a logic low level by coupling according to a voltage change of the output control signal GCK. Accordingly, the first transistor M11 and the eighth transistor M18 are turned on. The first power source voltage VGH is transferred to the first node N11 through the turned-on eighth transistor M18, and the second transistor M12 is turned off. The output control signal GCK of a logic low level is transferred to the output terminal OUT through the turned-on first transistor M11.

In this way, the plurality of scan driving blocks 210_1, 210_2, 210_3, 210_4, . . . simultaneously output scan signals S[1], S[2], S[3], S[4], . . . of a logic low level.

Segments after a segment t13 are segments of a scan step c in which a scan signal of a gate-on voltage is sequentially output to the plurality of scan lines S1-Sn. At segments after the segment t13, the output control signal GCK is applied as a voltage of a logic high level.

At a segment t13-t14, the scan start signal SSP is applied as a voltage of a logic low level. A voltage of the first clock signal CLK1 is repeatedly changed to a logic low level and a logic high level in a unit of 1 horizontal cycle (1H, a cycle of a horizontal synchronization signal) Hsync from a segment t13-t14. A voltage of the second clock signal CLK2 is repeatedly changed to a logic low level and a logic high level in a unit of 1 horizontal cycle 1H from a segment t14-t15. Thus, the second clock signal CLK2 is a signal in which the first clock signal CLK1 is shifted by duty of the first scan clock signal CLK1. Duty of a clock signal is a segment in which a voltage that turns on a transistor that is included in a scan driving block is applied.

At the segment t13-t14, a scan start signal SSP of a logic low level is applied to a first driving signal input terminal Input1 of a first scan driving block 210_1, and a first clock signal CLK1 of a logic low level is applied to a first clock signal input terminal CK1. The third transistor M13, the fourth transistor M14, the fifth transistor M15, and the sixth transistor M16 are turned on. A voltage of a logic low level is transferred to the first node N11, and a voltage of a logic high level is transferred to the second node N12. The first transistor M11 is turned off, and the second transistor M12 is turned on. A voltage of a logic high level is transferred to the output terminal OUT through the turned-on second transistor M12. The first capacitor C11 is charged by a voltage difference between a voltage of a logic low level of the first node N11 and a voltage of a logic high level of the output terminal OUT.

At a segment t14-t15, a first clock signal CLK1 of a logic high level is applied to the first clock signal input terminal CLK1 of the first scan driving block 210_1, and a second clock signal CLK2 of a logic low level is applied to the second clock signal input terminal CK2. The third transistor M13, the fourth transistor M14, and the sixth transistor M16 are turned off and thus the first node N11 and the second node N12 are in a floating state. A voltage of the second node N12 sustains a logic high level. The second transistor M12 is completely turned on by boot strap through the first capacitor C11. A voltage of a logic low level is transferred to the output terminal OUT through the turned-on second transistor M12. Accordingly, the first scan driving block 210_1 outputs a scan signal S[1] of a logic low level.

At a segment t14-t15, a scan signal S[1] of a logic low level of the first scan driving block 210_1 is applied to a first driving signal input terminal Input1 of a second scan driving block 210_2. A second clock signal CLK2 of a logic low level is applied to a first clock signal input terminal CK1 of the second scan driving block 210_2, and the first clock signal CLK1 of a logic high level is applied to the second clock signal input terminal CK2. The second scan driving block 210_2 operates like operation at a segment t14-t15 of the first scan driving block 210_1 and thus charges the first capacitor C11 by a voltage difference between a voltage of a logic low level of the first node N11 and a voltage of a logic high level of the output terminal OUT.

At a segment t15-t16, a second clock signal CLK2 of a logic high level is applied to the first clock signal input terminal CK1 of the second scan driving block 210_2, and a first clock signal CLK1 of a logic low level is applied to the second clock signal input terminal CK2. The second scan driving block 210_2 operates like operation at a segment t14-t15 of the first scan driving block 210_1 and thus outputs a scan signal S[2] of a logic low level.

At the segment t15-t16, the scan signal S[2] of a logic low level of the second scan driving block 210_2 is transferred to a second driving signal input terminal Input2 of the first scan driving block 210_1. A fourth transistor M14 of the first scan driving block 210_1 is turned on by the first clock signal CLK1 of a logic low level, and a seventh transistor M17 is turned on by the scan signal S[2] of the second scan driving block 210_2 of a logic low level. A voltage of a logic low level of the second power source voltage VGL is transferred to the second node N12 of the first scan driving block 210_1. The first transistor M11 and the eighth transistor M18 are turned on. A voltage of a logic high level is transferred to the output terminal OUT through the turned-on first transistor M11. The first power source voltage VGH is transferred to the first node N11 through the turned-on eighth transistor M18.

In this way, after a scan signal of a logic low level is output, by turning on the eighth transistor M18, the first power source voltage VGH is transferred to the first node N11, whereby the scan signal S[1] of the first scan driving block 210_1 may be prevented from being shaken by a clock signal that is applied to the second clock signal input terminal CK2.

By the above-described method, the plurality of scan driving blocks 210_1, 210_2, 210_3, 210_4, . . . sequentially output scan signals S[1], S[2], S[3], S[4], . . . of a logic low level.

After the scan driving block outputs a scan signal of a logic low level, when a voltage of a logic high level is not transferred to the first node N11, a voltage of the first node N11 may be shaken by a voltage change of a clock signal that is input to the second clock signal input terminal CK2. A voltage of the first node N11 may be shaken by coupling of the first node N11 and the output terminal OUT and thus an output signal of the output terminal OUT may be shaken.

However, after the scan driving block outputs a scan signal of a logic low level, by turning on the eighth transistor using a scan signal of a next scan driving block, the scan driving device transfers a voltage of a logic high level to the first node N11 and thus an output signal of the scan driving block may be prevented from being shaken.

Figure 6:
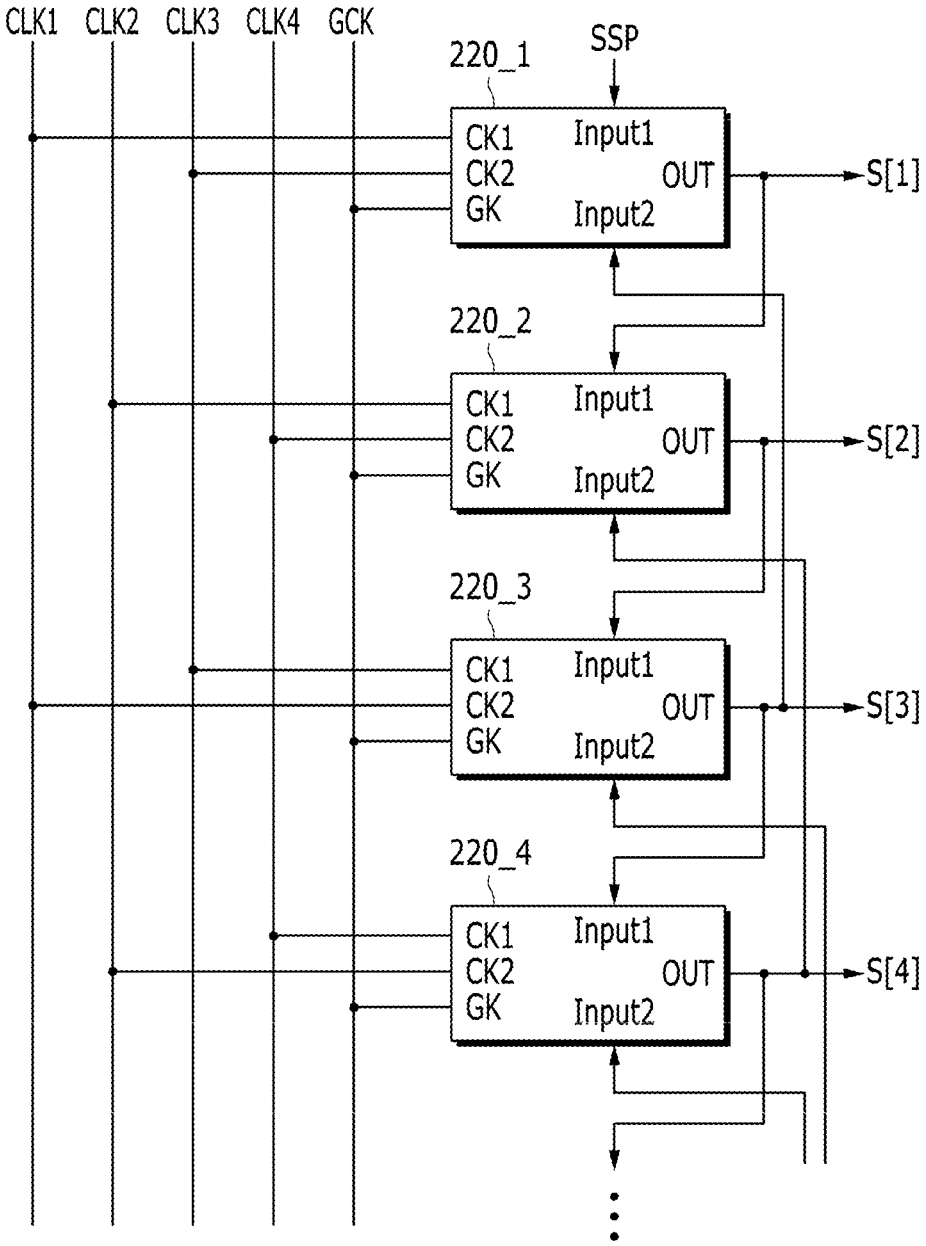
FIG. 6 is a block diagram illustrating a configuration of a scan driving device according to another example embodiment.

FIG. 6 is a block diagram illustrating a configuration of a scan driving device according to another example embodiment.

In the example embodiment shown in FIG. 6, the scan driving device includes a sequentially arranged plurality of scan driving blocks 220_1, 220_2, 220_3, 220_4, . . . . Each of scan driving blocks 220_1, 220_2, 220_3, 220_4, . . . may be formed like the scan driving blocks of FIG. 4.

A first clock signal CLK1 is input to a first clock signal input terminal CK1 of a first scan driving block 220_1 of the plurality of scan driving blocks 220_1, 220_2, 220_3, 220_4, . . . , and a third clock signal CLK3 is input to a second clock signal input terminal CK2 thereof. A second clock signal CLK2 is input to a first clock signal input terminal CK1 of a second scan driving block 220_2, and a fourth clock signal CLK4 is input to a second clock signal input terminal CK2 thereof. A third clock signal CLK3 is input to a first clock signal input terminal CK1 of a third scan driving block 220_3, and a first scan clock signal CLK1 is input to a second clock signal input terminal CK2 thereof. A fourth scan driving block 220_4 is input to a first clock signal input terminal CK1 of a fourth clock signal CLK4, and a second clock signal CLK2 is input to a second clock signal input terminal CK2 thereof.

The second clock signal CLK2 is a signal in which the first clock signal CLK1 is shifted by ½ duty of the first clock signal CLK1, a third clock signal CLK3 is a signal in which the second clock signal CLK2 is shifted by ½ duty of the second clock signal CLK2, and a fourth clock signal CLK4 is a signal in which the third clock signal CLK3 is shifted by ½ duty of the third clock signal CLK3.

In this way, a clock signal that is shifted by a duty of a clock signal that is input to the first clock signal input terminal CK1 is input to the second clock signal input terminal CK2 of a first scan driving block of one of the plurality of scan driving blocks 220_1, 220_2, 220_3, 220_4, . . . . A clock signal that is shifted by ½ duty of a clock signal that is input to the first clock signal input terminal CK1 of a first scan driving block is input to the first clock signal input terminal CK1 of a second scan driving block that is arranged after the first scan driving block. A clock signal that is shifted by ½ duty of a clock signal that is input to the second clock signal input terminal CK2 of the first scan driving block is input to a second clock signal input terminal CK2 of the second scan driving block.

An output control signal GCK is input to an output control signal input terminal GK of the plurality of scan driving blocks 220_1, 220_2, 220_3, 220_4, . . . .

When the plurality of scan driving blocks 220_1, 220_2, 220_3, 220_4, . . . sequentially output a scan signal, a scan signal S[k−1] of a (K−1)st scan driving block 220_k−1 is input to a first driving signal input terminal Input1 of a k-th scan driving block 220_k, and a scan signal S[k+2] of a (K+2)nd scan driving block 220_k+2 is input to a second driving signal input terminal Input2. In this case, a scan start signal SSP is input to a first driving signal input terminal Input1 of the first scan driving block 220_1.

Figure 7:
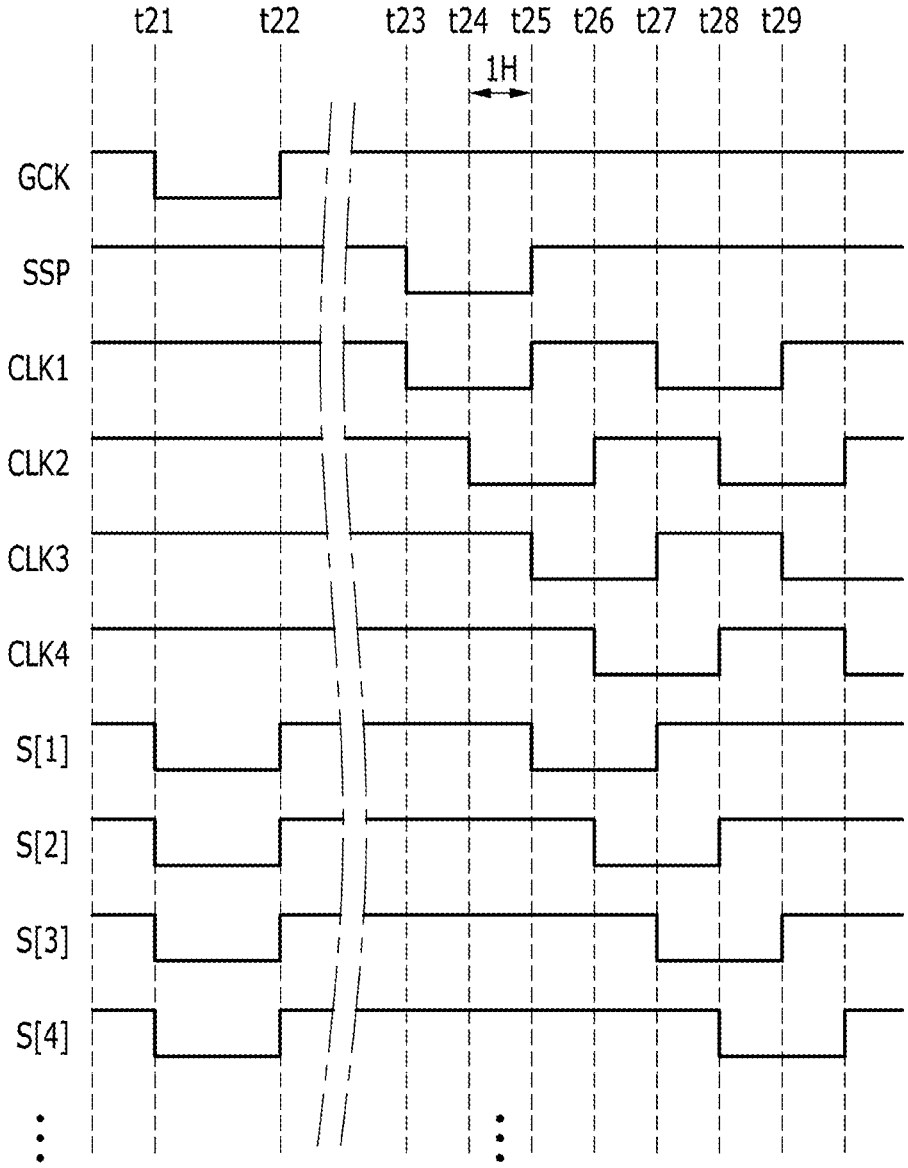
FIG. 7 is a timing diagram illustrating a method of driving the scan driving device of FIG. 6.

FIG. 7 is a timing diagram illustrating a method of driving the scan driving device of FIG. 6.

Referring to FIGS. 4, 6, and 7, the plurality of scan driving blocks 220_1, 220_2, 220_3, 220_4, . . . that are included in the scan driving device of FIG. 6 are formed like that of FIG. 4.

A segment t21-t22 is one segment of a reset step a and a threshold voltage compensation step b in which a scan signal of a gate-on voltage is simultaneously output to the plurality of scan lines S1-Sn. A driving operation at the segment t21-t22 is the same as a driving operation at the segment t11-t12 that is described in FIG. 5 and therefore a description thereof will be omitted.

Segments after a segment t23 are segments of a scan step c in which a scan signal of a gate-on voltage is sequentially output to the plurality of scan lines S1-Sn. At segments after the segment t23, an output control signal GCK is applied as a voltage of a logic high level. At a segment in which a scan signal of a gate-on voltage is sequentially output to a plurality of scan lines S1-Sn, a clock signal that is shifted by 1 duty of a clock signal that is input to a first clock signal input terminal CK1 of the plurality of scan driving blocks 220_1, 220_2, 220_3, 220_4, . . . is input to a second clock signal input terminal CK2.

A scan start signal SSP is applied as a voltage of a logic low level at a segment t23-t25. A voltage of a first clock signal CLK1 is repeatedly changed to a logic low level and a logic high level in a unit of 2 horizontal cycles from a segment t23-t25. A voltage of a second clock signal CLK2 is repeatedly changed to a logic low level and a logic high level in a unit of 2 horizontal cycles from a segment t24-t26. A voltage of a third clock signal CLK3 is repeatedly changed to a logic low level and a logic high level in a unit of 2 horizontal cycles from a segment t25-t27. A voltage of a fourth clock signal CLK4 is repeatedly changed to a logic low level and a logic high level in a unit of 2 horizontal cycles from a segment t26-t28.

Thus, the second clock signal CLK2 is a signal in which the first clock signal CLK1 is shifted by ½ duty of the first clock signal CLK1, the third clock signal CLK3 is a signal in which the second clock signal CLK2 is shifted by ½ duty of the second clock signal CLK2, and the fourth clock signal CLK4 is a signal in which the third clock signal CLK3 is shifted by ½ duty of the third clock signal CLK3.

At the segment t23-t25, a scan start signal SSP of a logic low level is applied to the first driving signal input terminal Input1 of the first scan driving block 220_1, and a first clock signal CLK1 of a logic low level is applied to the first clock signal input terminal CK1. A voltage of a logic low level is transferred to the first node N11, and a voltage of a logic high level is transferred to the second node N12. The second transistor M12 is turned on, and a voltage of a logic high level is transferred to the output terminal OUT through the turned-on second transistor M12. The first capacitor C11 is charged by a voltage difference between a voltage of a logic low level of the first node N11 and a voltage of a logic high level of the output terminal OUT.

At a segment t25-t27, a first clock signal CLK1 of a logic high level is applied to the first clock signal input terminal CK1 of the first scan driving block 220_1, and a third clock signal CLK3 of a logic low level is applied to a second clock signal input terminal CK2. The first node N11 and the second node N12 are in a floating state. A voltage of the second node N12 sustains a logic high level. A second transistor M12 is turned on by boot strap through the first capacitor C11. A voltage of a logic low level is transferred to the output terminal OUT through the turned-on second transistor M12. Accordingly, the first scan driving block 220_1 outputs a scan signal S[1] of a logic low level.

The second clock signal CLK2 is applied in a logic low level for a segment t24-t26, and a scan signal S[1] of a logic low level of the first scan driving block 220_1 is applied to a first driving signal input terminal Input1 of the second scan driving block 220_2 for a segment t25-t27. Accordingly, the second scan driving block 220_2 charges the first capacitor C11 by a voltage difference between a voltage of a logic low level of the first node N11 and a voltage of a logic high level of the output terminal OUT for a segment t25-t26.

At a segment t26-t28, a second clock signal CLK2 of a logic high level is applied to the first clock signal input terminal CK1 of the second scan driving block 220_2, and a fourth clock signal CLK4 of a logic low level is applied to a second clock signal input terminal CK2. The second scan driving block 220_2 outputs a scan signal S[2] of a logic low level by operating like operation at a segment t25-t27 of the first scan driving block 220_1.

At a segment t27-t29, a third scan driving block 220_3 outputs a scan signal S[3] of a logic low level by driving with the same method as that of the second scan driving block 220_2. A scan signal S[3] of a logic low level of the third scan driving block 220_3 is transferred to the second driving signal input terminal Input2 of the first scan driving block 220_1. A fourth transistor M14 of the first scan driving block 220_1 is turned on by the first clock signal CLK1 of a logic low level, and a seventh transistor M17 is turned on by the scan signal S[3] of the third scan driving block 220_of a logic low level. A second power source voltage VGL is transferred to the second node N12 of the first scan driving block 220_1. A first transistor M11 and an eighth transistor M18 of the first scan driving block 220_1 are turned on. A voltage of a logic high level is transferred to the output terminal OUT through the turned-on first transistor M11. In this case, a first power source voltage VGH is transferred to the first node N11 through the turned-on eighth transistor M18.

In this way, after a scan signal of a logic low level is output, by turning on the eighth transistor M18, the first power source voltage VGH is transferred to the first node N11, and thus a scan signal S[1] of the first scan driving block 220_1 may be prevented from being shaken by a clock signal that applied to the second clock signal input terminal CK2.

By the above-described method, the plurality of scan driving blocks 220_1, 220_2, 220_3, 220_4, . . . shift scan signals S[1], S[2], S[3], S[4], . . . having a duty of 2 horizontal cycle by 1 horizontal cycle and sequentially output the scan signals S[1], S[2], S[3], S[4], . . . .

Figure 8:
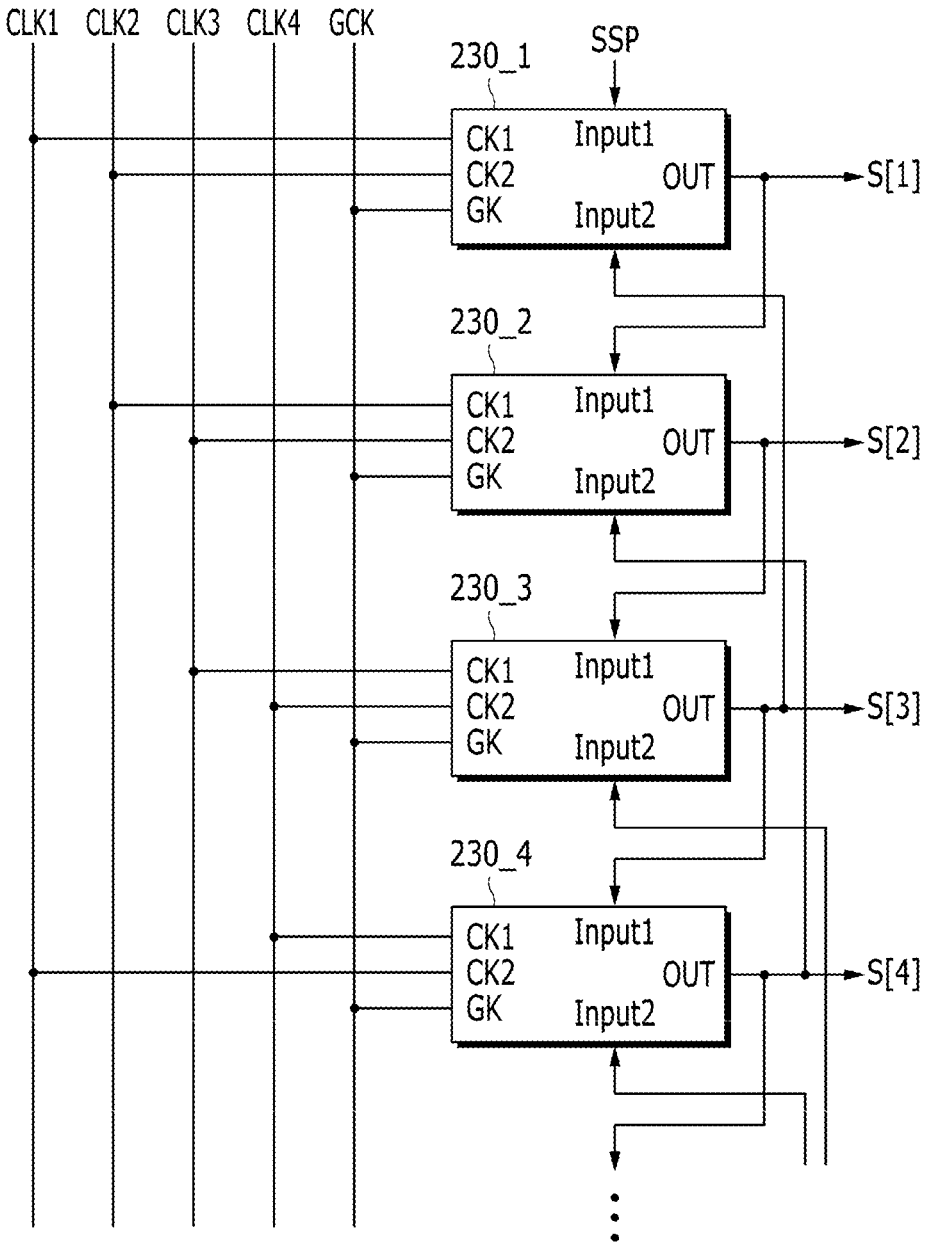
FIG. 8 is a block diagram illustrating a configuration of a scan driving device according to another example embodiment.

FIG. 8 is a block diagram illustrating a configuration of a scan driving device according to another example embodiment.

In the example embodiment shown in FIG. 8, the scan driving device includes a sequentially arranged plurality of scan driving blocks 230_1, 230_2, 230_3, 230_4, . . . . Each of the scan driving blocks 230_1, 230_2, 230_3, 230_4, . . . may be formed like the scan driving block of FIG. 4.

A first clock signal CLK1 is input to a first clock signal input terminal CK1 of a first scan driving block 230_1 of the plurality of scan driving blocks 230_1, 230_2, 230_3, 230_4, . . . , and a second clock signal CLK2 is input to a second clock signal input terminal CK2. The second clock signal CLK2 is input to a first clock signal input terminal CK1 of the second scan driving block 230_2, and a third clock signal CLK3 is input to the second clock signal input terminal CK2. The third clock signal CLK3 is input to a first clock signal input terminal CK1 of a third scan driving block 230_3, and a fourth clock signal CLK4 is input to the second clock signal input terminal CK2. The fourth clock signal CLK4 is input to a first clock signal input terminal CK1 of a fourth scan driving block 230_4, and the first clock signal CLK1 is input to the second clock signal input terminal CK2.

The second clock signal CLK2 is a signal in which the first clock signal CLK1 is shifted by ½ duty of the first clock signal CLK1, the third clock signal CLK3 is a signal in which the second clock signal CLK2 is shifted by ½ duty of the second clock signal CLK2, and the fourth clock signal CLK4 is a signal in which the third clock signal CLK3 is shifted by ½ duty of the third clock signal CLK3.

In this way, a clock signal that is shifted by ½ duty of a clock signal that is input to the first clock signal input terminal CK1 of the plurality of scan driving blocks 230_1, 230_2, 230_3, 230_4, . . . is input to the second clock signal input terminal CK2.

An output control signal GCK is input to an output control signal input terminal GK of the plurality of scan driving blocks 230_1, 230_2, 230_3, 230_4, . . . .

When the plurality of scan driving blocks 230_1, 230_2, 230_3, 230_4, . . . sequentially output a scan signal, a scan signal S[k−1] of a (K−1)st scan driving block 230_k−1 is input to a first driving signal input terminal Input1 of a k-th scan driving block 230_k, and a scan signal S[k+2] of a (K+2)nd scan driving block 230_k+2 is input to a second driving signal input terminal Input2. In this case, a scan start signal SSP is input to the first driving signal input terminal Input1 of the first scan driving block 230_1.

Figure 9:
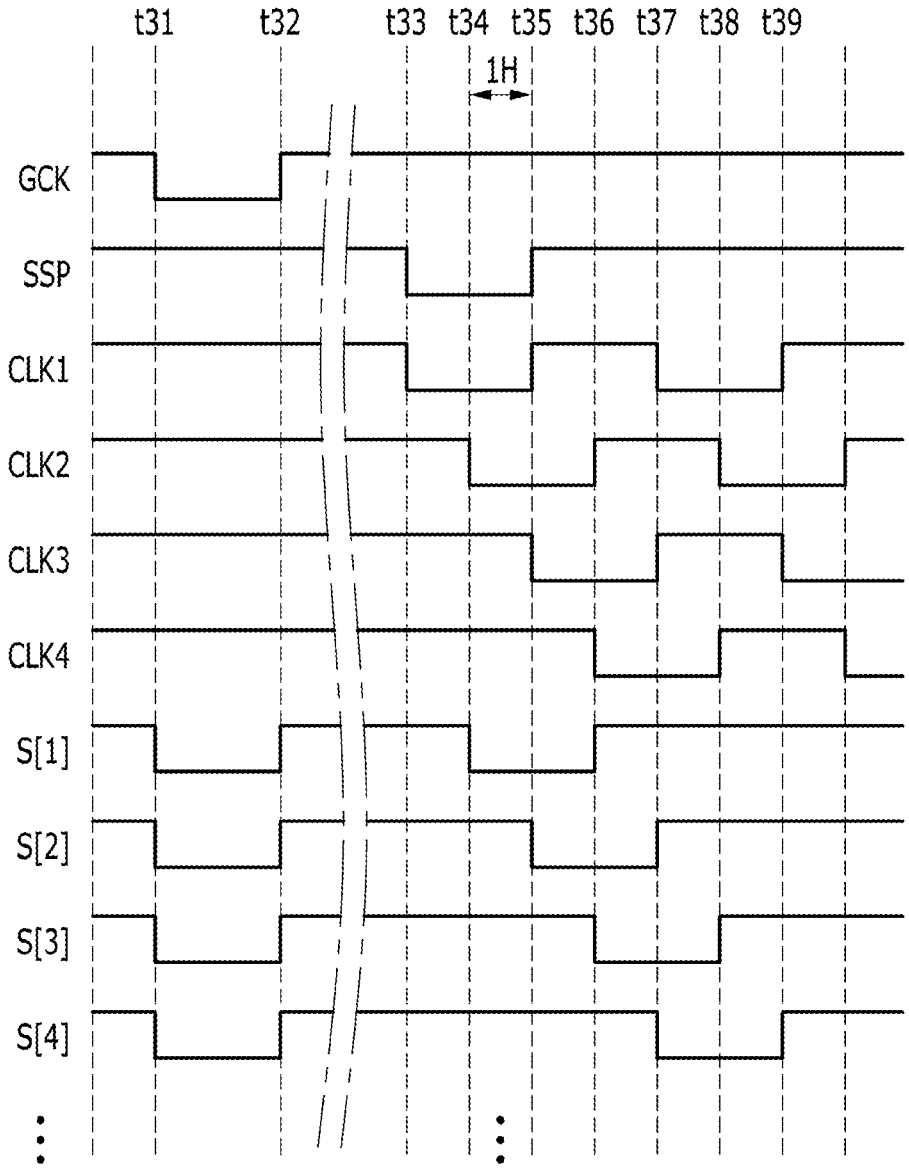
FIG. 9 is a timing diagram illustrating a method of driving the scan driving device of FIG. 8.

FIG. 9 is a timing diagram illustrating a method of driving the scan driving device of FIG. 8.

Referring to FIGS. 4, 8 and 9, the plurality of scan driving blocks 230_1, 230_2, 230_3, 230_4, . . . that are included in the scan driving device of FIG. 8 are formed, as shown in FIG. 4. A configuration of the scan driving device of FIG. 8 different from that of the scan driving device of FIG. 6 will be described.

A clock signal that is shifted by ½ duty of a clock signal that is input to the first clock signal input terminal CK1 of the plurality of scan driving blocks 230_1, 230_2, 230_3, 230_4, . . . is input to the second clock signal input terminal CK2. Compared with the driving method of FIG. 7, a time period that charges the first capacitor C11 of the plurality of scan driving blocks 230_1, 230_2, 230_3, 230_4, . . . is reduced to ½, and a rising time that outputs a scan signal in a logic high level and then outputs in a logic low level may be reduced. This will be described with, for example, the first scan driving block 230_1.

For a segment t33-t34 in which a scan start signal SSP and a first clock signal CLK1 are input in a logic low level and in which a second clock signal CLK2 is input in a logic high level, a first capacitor C11 is charged. At a time point t34, as the second clock signal CLK2 is input in a logic low level, charge of the first capacitor C11 is stopped, and a scan signal S[1] of a logic low level is output. Thus, the first capacitor C11 is charged for 1 horizontal cycle. Compared with the driving method of FIG. 7, a time period that charges the first capacitor C11 is reduced to ½.

At a time point t36, a scan signal S[3] of a logic low level that is output from a third scan driving block 230_3 is transferred to a second driving signal input terminal Input2 of the first scan driving block 230_1, and thus a seventh transistor M17 is turned on. In this case, because the first clock signal CLK1 is applied in a logic high level, a fourth transistor M14 is in a turn-off state, and a second power source voltage VGL is not transferred to a second node N12. Therefore, a voltage of the first node N11 sustains a logic low level, and a second clock signal CLK2 that is applied to a second clock signal input terminal CK2 is continuously output. At a time point t36, a voltage of the second clock signal CLK2 increases to a logic high level, and the second clock signal CLK2 transfers a voltage of a logic high level to the output terminal OUT.

At a time point t37, the first clock signal CLK1 is lowered to a logic low level, and a fourth transistor M14 is turned on. The second power source voltage VGL is transferred to the second node N12 to turn on the first transistor M11 and the eighth transistor M18. A voltage of a logic high level is transferred to the output terminal OUT through the turned-on first transistor M11.

In the driving method of FIG. 7, the second transistor M12 has a size relatively larger than that of the first transistor M11. When a voltage of a logic high level is transferred to the first node N11 and a voltage of a logic low level is transferred to the second node N12, a time period in which the second transistor M12 is turned off may be longer than a time period in which the first transistor M11 is turned on. Further, a voltage change of a clock signal that is input to the second clock signal input terminal CK2 may be delayed. Accordingly, when a voltage of a logic high level is transferred to the output terminal OUT through the first transistor M12, a voltage of a logic low level is temporarily transferred to the output terminal OUT through the second transistor M12, and thus a rising time in which a voltage of the output terminal OUT increases from a logic low level to a logic high level may increase.

In a driving method of FIG. 9, when a scan driving block outputs a scan signal to a logic low level and then outputs to a logic high level, first transfers a voltage of a logic high level to the output terminal OUT through the turned-on second transistor M12, and then turns off the second transistor M12 and turns on the first transistor M11. Accordingly, a rising time in which a voltage of the output terminal OUT rises from a logic low level to a logic high level may be reduced.

Figure 10:
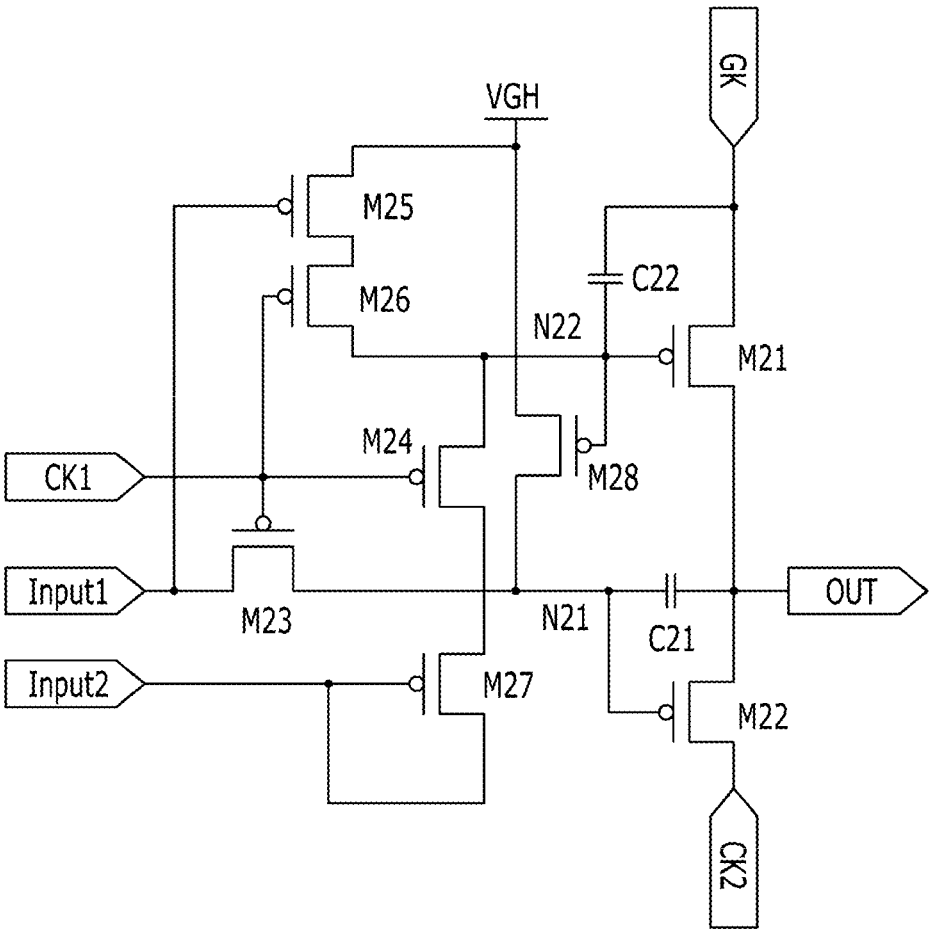
FIG. 10 is a circuit diagram illustrating another example embodiment of a scan driving block that is included in one scan driving device of FIGS. 3, 6, and 8.

FIG. 10 is a circuit diagram illustrating another example embodiment of a scan driving block that is included in any one scan driving device of FIGS. 3, 6, and 8.

In the example embodiment shown in FIG. 10, the scan driving block includes a plurality of transistors M21, M22, M23, M24, M25, M26, M27, and M28, and a plurality of capacitors C21 and C22.

The first transistor M21 includes a gate electrode that is connected to a second node N22, one electrode that is connected to an output control signal input terminal GCK, and another electrode that is connected to an output terminal OUT.

A second transistor M22 includes a gate electrode that is connected to a first node N21, one electrode that is connected to a second clock signal input terminal CLK2, and another electrode that is connected to the output terminal OUT.

A third transistor M23 includes a gate electrode that is connected to the first clock signal input terminal CLK1, one electrode that is connected to the first driving signal input terminal Input1, and another electrode that is connected to the first node N21.

A fourth transistor M24 includes a gate electrode that is connected to the first clock signal input terminal CLK1, one electrode that is connected to another electrode of a seventh transistor M27, and another electrode that is connected to a second node N22.

A fifth transistor M25 includes a gate electrode that is connected to the first driving signal input terminal Input1, one electrode that is connected to a first power source voltage VGH, and another electrode that is connected to one electrode of a sixth transistor M26.

The sixth transistor M26 includes a gate electrode that is connected to the first clock signal input terminal CLK1, one electrode that is connected to the other electrode of the fifth transistor M25, and another electrode that is connected to the second node N22.

The seventh transistor M27 includes a gate electrode that is connected to a second driving signal input terminal Input2, one electrode that is connected to the second driving signal input terminal Input2, and another electrode that is connected to one electrode of the fourth transistor M24.

An eighth transistor M28 includes a gate electrode that is connected to the second node N22, one electrode that is connected to the first power source voltage VGH, and another electrode that is connected to the first node N21.

The first capacitor C21 includes one electrode that is connected to the first node N21 and another electrode that is connected to the output terminal OUT. A second capacitor C22 includes one electrode that is connected to an output control signal input terminal GCK and another electrode that is connected to the second node N22.

Compared with the scan driving block of FIG. 4, the second power source voltage VGL is not connected to one electrode of the seventh transistor M27, but the second driving signal input terminal Input2 is connected to one electrode of the seventh transistor M27. Thus, by diode-connecting a scan signal (a scan signal of a (K+1)st scan driving block in FIG. 3, or a scan signal of a (K+2)nd scan driving block in FIGS. 6 and 8) that is input to the second driving signal input terminal Input2 to the seventh transistor M27, the second power source voltage VGL may not be used.

Figure 11:
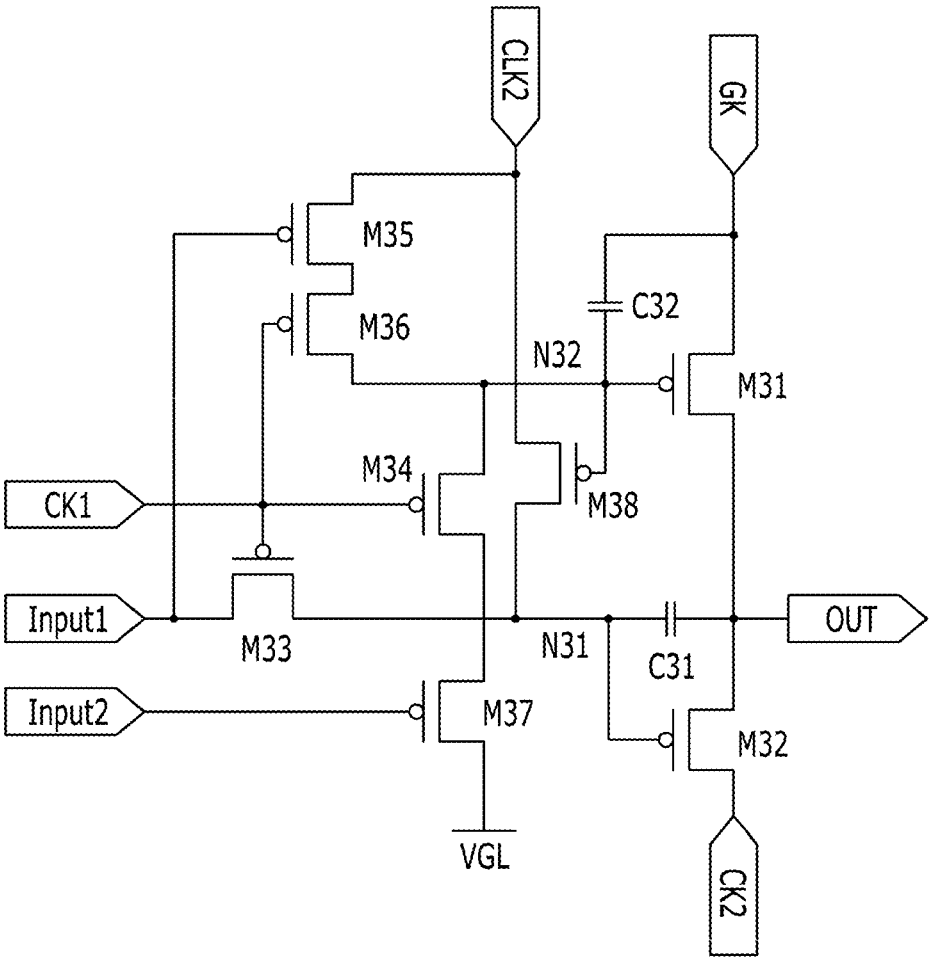
FIG. 11 is a circuit diagram illustrating another example embodiment of a scan driving block that is included in one scan driving device of FIGS. 3, 6, and 8.

FIG. 11 is a circuit diagram illustrating another example embodiment of a scan driving block that is included in any one scan driving device of FIGS. 3, 6, and 8.

In the example embodiment shown in FIG. 11, the scan driving block includes a plurality of transistors M31, M32, M33, M34, M35, M36, M37, and M38 and a plurality of capacitors C31 and C32.

A first transistor M31 includes a gate electrode that is connected to a second node N32, one electrode that is connected to an output control signal input terminal GCK, and another electrode that is connected to an output terminal OUT.

A second transistor M32 includes a gate electrode that is connected to a first node N31, one electrode that is connected to a second clock signal input terminal CLK2, and another electrode that is connected to the output terminal OUT.

A third transistor M33 includes a gate electrode connected to a first clock signal input terminal CLK1, one electrode that is connected to a first driving signal input terminal Input1, and another electrode that is connected to the first node N31.

A fourth transistor M34 includes a gate electrode that is connected to the first clock signal input terminal CLK1, one electrode that is connected to another electrode of a seventh transistor M37, and another electrode that is connected to the second node N32.

A fifth transistor M35 includes a gate electrode that is connected to the first driving signal input terminal Input1, one electrode that is connected to a second clock signal input terminal CLK2, and another electrode that is connected to one electrode of a sixth transistor M36.

The sixth transistor M36 includes a gate electrode that is connected to the first clock signal input terminal CLK1, one electrode that is connected to the other electrode of the fifth transistor M35, and another electrode that is connected to the second node N32.

The seventh transistor M37 includes a gate electrode that is connected to a second driving signal input terminal Input2, one electrode that is connected to a second power source voltage VGL, and another electrode that is connected to one electrode of the fourth transistor M34.

An eighth transistor M38 includes a gate electrode that is connected to the second node N32, one electrode that is connected to the second clock signal input terminal CLK2, and another electrode that is connected to the first node N31.

A first capacitor C31 includes one electrode that is connected to the first node N31 and another electrode that is connected to the output terminal OUT. A second capacitor C32 includes one electrode that is connected to the output control signal input terminal GCK and another electrode that is connected to the second node N32.

Compared with the scan driving block of FIG. 4, a first power source voltage VGH is not connected to one electrode of a fifth transistor M35 and one electrode of an eighth transistor M38, but a second clock signal input terminal CLK2 is connected to one electrode of a fifth transistor M35 and one electrode of an eighth transistor M38. Thus, when a clock signal that is input to the first clock signal input terminal CLK1 is a logic low level, by using a clock signal that is applied to a logic high level, the first power source voltage VGH may not be used.

By way of summation and review, a scan driving device may have a structure in which a plurality of scan driving blocks are sequentially arranged so as to sequentially output a scan signal of a gate-on voltage. A plurality of scan driving blocks may sequentially output a scan signal of a gate-on voltage using a method in which a subsequent scan driving block receives an output signal of a previously arranged scan driving block to generate an output signal. In this case, a plurality of clock signals may be used for corresponding synchronization of a plurality of scan driving blocks. A clock signal may periodically change to a voltage of a logic high level and a voltage of a logic low level.

At a segment in which a scan signal should be applied to a voltage of a constant level, an output signal of the scan driving device may be shaken by a clock signal in which a voltage level periodically changes. When an output signal of a previously arranged scan driving block of a plurality of scan driving blocks may be shaken by a clock signal, an output signal of a subsequent scan driving block that receives the output signal may be influenced, and accumulation of such an influence may cause an erroneous operation of the scan driving device.

As described herein, embodiments may provide a scan driving device and a method of driving the same that help prevent an output signal being shaken by a clock signal. Thus, the scan driving device may prevent a scan signal from shaking according to a voltage change of a clock signal and stably output a scan signal.

While this invention has been described in connection with what is presently considered to be practical example embodiments, it is to be understood that the invention is not limited to the disclosed embodiments, but, on the contrary, is intended to cover various modifications and equivalent arrangements included within the spirit and scope of the appended claims.

DESCRIPTION OF SYMBOLS

100: signal controller
200: scan driving device
210: scan driving block
300: data driver
500: display unit

What is claimed is:

1. A scan driving device, comprising:

a plurality of sequentially arranged scan driving blocks, each of the plurality of scan driving blocks including:

a first node to which a signal that is input to a first driving signal input terminal is transferred according to a clock signal that is input to a first clock signal input terminal;

a second node to which a second power source voltage is transferred according to the clock signal that is input to the first clock signal input terminal and a signal that is input to a second driving signal input terminal;

a first transistor including a gate electrode that is directly connected to the second node, a first electrode to which an output control signal is input, and a second electrode;

a second transistor including a gate electrode that is connected to the first node, a first electrode that is connected to a second clock signal input terminal, and a second electrode; and a third transistor including a gate electrode that is directly connected to the second node, an electrode that is connected to a first power source voltage, and another electrode that is connected to the first node, wherein the second electrode of the first transistor and the second electrode of the second transistor are commonly connected at an output terminal outputting a scan signal.

2. The scan driving device of claim 1, wherein each of the plurality of scan driving blocks further includes a fourth transistor including a gate electrode that is connected to the first clock signal input terminal, an electrode that is connected to the first clock signal input terminal, and another electrode that is connected to the first node.

3. The scan driving device of claim 1, wherein each of the plurality of scan driving blocks further includes:

a fifth transistor including a gate electrode that is connected to the first driving signal input terminal and an electrode that is connected to the first power source voltage; and a sixth transistor including a gate electrode that is connected to the first clock signal input terminal, an electrode that is connected to another electrode of the fifth transistor, and another electrode that is connected to the second node.

4. The scan driving device of claim 1, wherein each of the plurality of scan driving blocks further includes:

a seventh transistor including a gate electrode that is connected to the second driving signal input terminal and an electrode that is connected to the second power source voltage; and an eighth transistor including a gate electrode that is connected to the first clock signal input terminal, an electrode that is connected to another electrode of the seventh transistor, and another electrode that is connected to the second node.

5. The scan driving device of claim 1, wherein each of the plurality of scan driving blocks further includes a first capacitor including an electrode that is connected to the first node and another electrode that is connected to the output terminal.

6. The scan driving device of claim 1, wherein each of the plurality of scan driving blocks further includes a second capacitor including an electrode to which the output control signal is input and another electrode that is connected to the second node.

7. The scan driving device of claim 1, wherein:

a first clock signal is input to a first clock signal input terminal of a plurality of first scan driving blocks of the plurality of scan driving blocks, and a second clock signal is input to a second clock signal input terminal thereof, and the second clock signal is input to a first clock signal input terminal of a remaining plurality of second scan driving blocks of the plurality of scan driving blocks, and the first clock signal is input to a second clock signal input terminal thereof.

8. The scan driving device of claim 7, wherein the second clock signal is a signal that is shifted by duty of the first clock signal.

9. The scan driving device of claim 8, wherein:

a scan signal of a previously arranged second scan driving block is input to the first driving signal input terminal of a subsequently arranged first scan driving block, and a scan signal of a subsequently arranged second scan driving block is input to a second driving signal input terminal of a previously arranged first scan driving block.

10. The scan driving device of claim 9, wherein:

a scan signal of the previously arranged first scan driving block is input to the first driving signal input terminal of the subsequently arranged second scan driving block, and a scan signal of the subsequently arranged first scan driving block is input to the first driving signal input terminal of the previously arranged second scan driving block.

11. The scan driving device of claim 1, wherein:

a first clock signal is input to a first clock signal input terminal of a first scan driving block of one of the plurality of scan driving blocks, and a third clock signal that is shifted by duty of the first clock signal is input to the second clock signal input terminal of the first scan driving block, and a second clock signal that is shifted by ½ duty of the first clock signal is input to a first clock signal input terminal of a second scan driving block that is arranged after the first scan driving block, and a fourth clock signal that is shifted by ½ duty of the third clock signal is input to the second clock signal input terminal of the second scan driving block.

12. The scan driving device of claim 11, wherein:

a scan signal of a previously arranged scan driving block is input to the first driving signal input terminal of the first scan driving block, and a scan signal of a scan driving block that is arranged after the second scan driving block is input to the second driving signal input terminal of the first scan driving block.

13. The scan driving device of claim 12, wherein a scan signal of the first scan driving block is input to the first driving signal input terminal of the second scan driving block.

14. The scan driving device of claim 1, wherein:

a first clock signal is input to a first clock signal input terminal of a first scan driving block of one of the plurality of scan driving blocks, and a second clock signal that is shifted by ½ duty of the first clock signal is input to the second clock signal input terminal of the first scan driving block, the second clock signal is input to the first clock signal input terminal of a second scan driving block that is arranged after the first scan driving block, and a third clock signal that is shifted by ½ duty of the second clock signal is input to the second clock signal input terminal of the second scan driving block, and the third clock signal is input to a first clock signal input terminal of a third scan driving block that is arranged after the second scan driving block, and a fourth clock signal that is shifted by ½ duty of the third clock signal is input to the second clock signal input terminal of the third scan driving block.

15. The scan driving device of claim 14, wherein:

a scan signal of a previously arranged scan driving block is input to the first driving signal input terminal of the first scan driving block, and a scan signal of the third scan driving block is input to the second driving signal input terminal of the first scan driving block.

16. The scan driving device of claim 15, wherein a scan signal of the first scan driving block is input to a first driving signal input terminal of the second scan driving block.

17. A scan driving device, comprising:

a first node to which a signal that is input to a first driving signal input terminal is transferred according to a clock signal that is input to a first clock signal input terminal;

a second node to which a signal that is input to a second driving signal input terminal is transferred according to the clock signal that is input to the first clock signal input terminal and the signal that is input to the second driving signal input terminal;

a first transistor including a gate electrode that is directly connected to the second node, a first electrode to which an output control signal is input, and a second electrode;

a second transistor including a gate electrode that is connected to the first node, a first electrode that is connected to a second clock signal input terminal, and a second electrode; and a third transistor including a gate electrode that is directly connected to the second node, an electrode that is connected to a first power source voltage, and another electrode that is connected to the first node, wherein the second electrode of the first transistor and the second electrode of the second transistor are commonly connected at an output terminal outputting a scan signal.

18. A scan driving device, comprising:

a first node to which a signal that is input to a first driving signal input terminal is transferred according to a clock signal that is input to a first clock signal input terminal;

a second node to which a second power source voltage is transferred according to the clock signal that is input to the first clock signal input terminal and a signal that is input to a second driving signal input terminal;

a first transistor including a gate electrode that is directly connected to the second node, a first electrode to which an output control signal is input, and a second electrode;

a second transistor including a gate electrode that is connected to the first node, a first electrode that is connected to a second clock signal input terminal, and a second electrode; and a third transistor including a gate electrode that is directly connected to the second node, an electrode that is connected to the second clock signal input terminal, and another electrode that is connected to the first node, wherein the second electrode of the first transistor and the second electrode of the second transistor are commonly connected at an output terminal outputting a scan signal.

19. A method of driving a scan driving device that includes a plurality of scan driving blocks each including a first node, a second node, a first clock signal input terminal receiving a first clock signal, a first transistor that has a gate electrode directly connected to the second node, a first electrode to which an output control signal is input, and a second electrode, the first transistor that transfers the output control signal to an output terminal outputting a scan signal, a second transistor that has a gate electrode connected to the first node, a first electrode to which a second clock signal is input, and a second electrode, the second transistor that transfers the second clock signal to the output terminal, a third transistor that has a gate electrode directly connected to the second node, a first electrode that is connected to a first power source voltage, and a second electrode that is connected to the first node, the third transistor that transfers a gate-off voltage to the first node, and a capacitor that is connected to the first node and the output terminal, wherein the second electrode of the first transistor and the second electrode of the second transistor are commonly connected at the output terminal outputting the scan signal, the method comprising:

changing a voltage of the second node by the output control signal of a gate-on voltage;

turning on the first transistor by a voltage change of the second node and outputting the output control signal of the gate-on voltage as the scan signal to the output terminal; and turning on the third transistor by a voltage change of the second node and turning off the second transistor by a first power source voltage having the gate-off voltage.

20. The method of claim 19, wherein the changing of a voltage of the second node and the outputting of the output control signal of the gate-on voltage simultaneously occur in the plurality of scan driving blocks.

21. The method of claim 19, further comprising:

applying a previous scan signal of a gate-on voltage that is output by a previously arranged scan driving block of the plurality of scan driving blocks according to the second clock signal to the first node;

turning on the second transistor by a gate-on voltage of the first node and outputting the second clock signal of a gate-off voltage as the scan signal to the output terminal; and charging the capacitor with a gate-on voltage of the first node and a gate-off voltage of the output terminal.

22. The method of claim 21, wherein the second clock signal is a signal that is shifted by duty of the first clock signal.

23. The method of claim 21, wherein the second clock signal is a signal that is shifted by ½ duty of the first clock signal.

24. The method of claim 21, further comprising:

changing the first clock signal to a gate-on voltage;

turning on the second transistor by boot strap through the capacitor; and outputting the second clock signal of the gate-on voltage as the scan signal to the output terminal.

25. The method of claim 24, further comprising:

applying a gate-on voltage to the second node by the second clock signal and a scan signal of a gate-on voltage of a subsequently arranged scan driving block of the plurality of scan driving blocks;

turning on the first transistor by a gate-on voltage of the second node and outputting an output control signal of a gate-off voltage as the scan signal to the output terminal; and transferring a gate-off voltage to the first node by turning on the third transistor by a gate-on voltage of the second node and turning off the second transistor by a gate-off voltage of the first node.

* * * * *